US006409551B1

(12) United States Patent
Nagai

(10) Patent No.: US 6,409,551 B1
(45) Date of Patent: Jun. 25, 2002

(54) PRESS-FIT CONNECTOR

(75) Inventor: Kentaro Nagai, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,723

(22) Filed: Aug. 4, 2000

(30) Foreign Application Priority Data

Aug. 6, 1999 (JP) ..... 11-224160

(51) Int. Cl.[7] ..... H01R 13/502; H01R 13/514
(52) U.S. Cl. ..... 439/701; 439/404
(58) Field of Search ..... 439/404, 700, 439/701, 717, 731, 696, 687

(56) References Cited

U.S. PATENT DOCUMENTS 5,460,545 A * 10/1995 Siemon et al. ..... 439/308
5,934,944 A * 8/1999 Aoyama et al. ..... 439/701
6,113,437 A * 9/2000 Abe ..... 439/701

FOREIGN PATENT DOCUMENTS

JP 11-40242 2/1999
JP 11-67327 3/1999

* cited by examiner

*Primary Examiner*—Gary Paumen
*Assistant Examiner*—Felix O. Figueroa
(74) *Attorney, Agent, or Firm*—Finnegan, Henderson, Farabow, Garrett, & Dunner, L.L.P.

(57) ABSTRACT

There is provided a press-fit connector 20 in which connecting faces 21*a* and 22*a* of a cover 21 and a 22 are moved in a direction in which both the connecting faces approach each other and moved to connecting position, the connector housing 22 is provided with a plurality of partition walls 24 for partitioning the housing into terminal accommodating chambers 23, the cover 21 is also provided with a plurality of partition walls at positions opposed to the former partitioning walls, both the partitioning walls 24 move in a direction in which they approach each other when the connecting faces moved to the connecting position, and tip end faces of both the partitioning walls 24 roughly abut against each other at the connecting position. When the connecting faces move to the connecting position, the positioning operation is started before the press-fit terminals and the partitioning walls of the cover 21 which are opposed to the press-fit terminals come to the position where they can come into contact with each other, and if a direction in which the partitioning walls 24 extend is defined as an extending direction, positioning projections 32*a* and positioning recesses 32*b* for positioning the cover 21 and the connector housing 22 in a direction S perpendicular to the extending direction T.

3 Claims, 6 Drawing Sheets

PRESS-FIT CONNECTOR

BACKGROUND OF THE INVENTION

1. Field of the Invention

The present invention relates to a press-fit connector having two connector housings which are connected to each other by moving them into a direction in which they approach each other.

2. Description of the Related Art

A conventional press-fit connector of this kind has been proposed (Japanese Patent Application No. H9-223764, which is not prior art).

As shown in FIGS. 1 to 5, a press-fit connector 1 comprises an upper connector housing 2 and a lower connector housing 3. A lower face 2*a* of the upper connector housing 2 and an upper face 3*a* of the lower connector housing 3 are formed as connecting faces which are opposed to each other. A plurality of longitudinally formed terminal accommodation chambers 4 are arranged side-by-side in the upper connector housing 2. The adjacent terminal accommodation chambers 4 are partitioned by partition walls 5. The lower face (connecting face) 2*a* of the upper connector housing 2 is formed at its rear portion with an opening 6, and rear portions of the terminal accommodation chambers 4 are exposed from the opening 6. As shown in FIG. 4, press-fit terminals 7 are respectively accommodated in the terminal accommodation chambers 4, and one ends of an electric wire W are arranged to be press-fitted to a pair of press-fit blades 7*a* and 7*a* on the rear portion of each of the press-fit terminals 7. Each of the pair of press-fit blades 7*a* and 7*a* is bent into a substantially U-shape, and tip ends 7*b* and 7*b* of opposite side plates of each of the press-fit terminals 7 project upward from the partition wall 5.

The lower face (connecting face) 2*a* of the upper connector housing 2 is provided at its front portion with three longitudinally extending front first locking projections 8 which are substantially trapezoidal in shape. The first locking projections 8 are formed on the center portion and left and right sides of the front portion of the lower face 2*a* at certain distances from one another. Front opposite ends of the lower face 2*a* of the upper connector housing 2 are provided with front second locking projections 9. As shown in FIG. 2, each of the front second locking projections 9 comprises a substantially semicircular introducing rib 9*a* which is downwardly projecting, an introducing taper projection 9*b* obliquely formed from a tip end of the introducing rib 9*a,* and a flat projection 9*c* projecting horizontally from a bottom face of the introducing taper projection 9*b.* Rear portions of opposite sides of the upper connector housing 2 are provided with prism rear locking projections 10.

A plurality of longitudinally formed terminal accommodation chambers 4 are arranged side-by-side in the lower connector housing 3. A rear portion of the lower face of the lower connector housing 3 is formed into an opening 6, and rear portions of the terminal accommodation chambers 4 are exposed from the opening 6. Press-fit terminals (not shown) are respectively accommodated in the terminal accommodation chambers 4 in the same manner as that described above.

A cover 11 is connected to a lower face of the lower connector housing 3 through a hinge (not shown) so that the opening 6 can be closed with the cover 11. A rear portion of the upper face (connecting face) 3*a* of the lower connector housing 3 is provided with a plurality of partition walls 12 such as to be opposed to the plurality of partition walls 5 of the upper connector housing 2. Further, electric wire position restricting projections 13 are respectively provided between adjacent partition walls 12.

The upper face (connecting face) 3*a* of the lower connector housing 3 is provided at its front portion with three front first locking recesses 14 which are substantially trapezoidal in shape. The first locking recesses 14 are formed on the center portion and left and right sides of the front portion of the upper face 3*a* at certain distances from one another. Front opposite ends of the upper face 3*a* of the lower connector housing 3 are provided with front second locking recesses 15. As shown in FIG. 3, each of the front second locking recesses 15 comprises a guide taper recess 15*a* in which the introducing rib 9*a* and the introducing taper projection 9*b* are inserted, and a horizontal recess 15*b* in which the flat projection 9*b* is inserted. Rear portions of the opposite sides of the lower connector housing 3 are provided flexibly rear-locking arms 16 which are respectively provided with rear locking holes 17.

In the above structure, the press-fit terminals 7 are accommodated in the terminal accommodation chambers 4 of the connector housings 2 and 3, the one ends of the electric wire W are connected to the press-fit terminals 7, and the opening 6 of the lower connector housing 3 is closed with the cover 11. Next, the upper connector housing 2 is set to a coupling jig (not shown) such that the lower face 2*a* of the upper connector housing 2 is directed upward, and the lower connector housing 3 is placed on the set upper connector housing 2 from above such that the upper face 3*a* of the lower connector housing 3 is directed downward. When the lower connector housing 3 is placed, the front first locking projections 8, the front second locking projections 9 and the rear locking projections 10 of the upper connector housing 2 are substantially positioned on the front first locking recesses 14, the front second locking recesses 15, and the rear locking arms 16 of the lower connector housing 3.

Next, the lower connector housing 3 is pushed downward, the opposed connecting faces of both the connecting housings 2 and 3 are moved in a direction in which they approach each other by this pushing force, and at the connected position, the front first locking projections 8 and the front second locking projections 9 enter the front first locking recesses 14 and the front second locking recesses 15 respectively, and the rear locking projections 10 are locked in the rear locking holes 17 by the rear locking arms 16 which are bent and deformed. With this operation, both the connector housings 2 and 3 are coupled.

As both the connector housings 2 and 3 are moved to the connected positions, both the partition walls 5 and 12 are moved in a direction in which they approach each other, and at the connected position, tip end faces of both the partition walls 5 and 12 are brought into substantially contact with each other. With this movement, the adjacent terminal accommodation chambers 4 are substantially completely partitioned, thereby preventing a short out accident between the adjacent press-fit terminals 7 and 7.

However, in the conventional press-fit connector 1, the positioning operation of both the connector housings 2 and 3 are started simultaneously when the locking operation is started during the connecting operation procedure. That is, the positioning operation of the front portions of both the connector housings 2 and 3 are carried out by starting the insertion operation of the front first locking projections 8 and the front second locking projections 9 into the front first locking recesses 14 and the front second locking recesses 15, respectively, and the positioning operation of the rear portions of both the connector housings 2 and 3 are carried out by starting the engaging operation of the rear locking projections 10 into the rear locking arms 16 which can be bent and deformed. Therefore, both the connector housings 2 and 3 are not positioned until they sufficiently approach each other.

For this reason, if both the connector housings 2 and 3 are moved to the connected position in a state where the lower connector housing 3 is laterally deviated from a proper position, the partition wall 12 of the lower connector housing 3 abuts against the tip ends 7*a* of the side plates of the press-fit terminals 7 as shown in FIG. 4, and the tip ends 7*a* of the side plates of the press-fit terminals 7 are folded and bent. As shown in FIG. 5, if the tip ends 7*a* of the side plates of the press-fit terminals 7 are bent outwardly, the tip ends 7*a* may adversely come into contact with the adjacent press-fit terminals 7 to cause a short.

SUMMARY OF THE INVENTION

It is an object of the present invention to provide a press-fit connector capable of preventing a short out accident between adjacent terminals at the time of connecting operation.

According to a first aspect of the present invention, there is provided a press-fit connector comprising: a first connector housing; a second connector housing; locking means which is moved to a connecting position by moving opposed connecting faces of the first and second connector housing in a direction in which they approach each other, locking means starting engaging the connector housings with each other when the first and second housings move to the connecting position, and the locking means completing the engagement between both the connector housings at the connecting position, thereby locking both the first and second connector housings; a plurality of partition walls for partitioning the first connector housing into terminal accommodating chambers for accommodating terminals; other plurality of partition walls for partitioning the second connector housing into terminal accommodating chambers for accommodating terminals; and positioning means for moving move both the partitioning walls of the first and second connector housing as the first and second connector housing move to the connecting position, the positioning means roughly bringing tip end faces of both the partitioning walls into contact with each other at the connecting position, the press-fit means starting the positioning operation of the opposed connecting faces of the first and second connector housings before the terminals and the partition walls opposed thereto con to positions where they come into contact with each other when both the connector housing move to the connecting position, and if a direction in which the partition walls extend is defined as an extending direction, and the positioning means positioning both the connector housings in a direction perpendicular to the extending direction.

According to this press-fit connector, if the opposed connecting faces of both the connector housing in a direction in which they approach each other, the positioning means starts the positioning operation, and after both the connector housing have been positioned in the direction perpendicular to the extending direction, the terminals and the partitioning walls which are opposed to the terminals come to positions where they can come into contact with each other.

According to a second aspect, in the press-fit connector of the first aspect, the positioning means is provided at a substantially central position of both the connector housings in the direction perpendicular to the extending direction.

According to this press-fit connector, in addition to the effect of the first aspect, since the central position of the connector housings becomes a reference position, error in position at opposite ends of both the connector housings can be minimized.

DESCRIPTION OF THE PREFERRED EMBODIMENTS

An embodiment of the present invention will be explained based on the drawings below.

Figure 1:
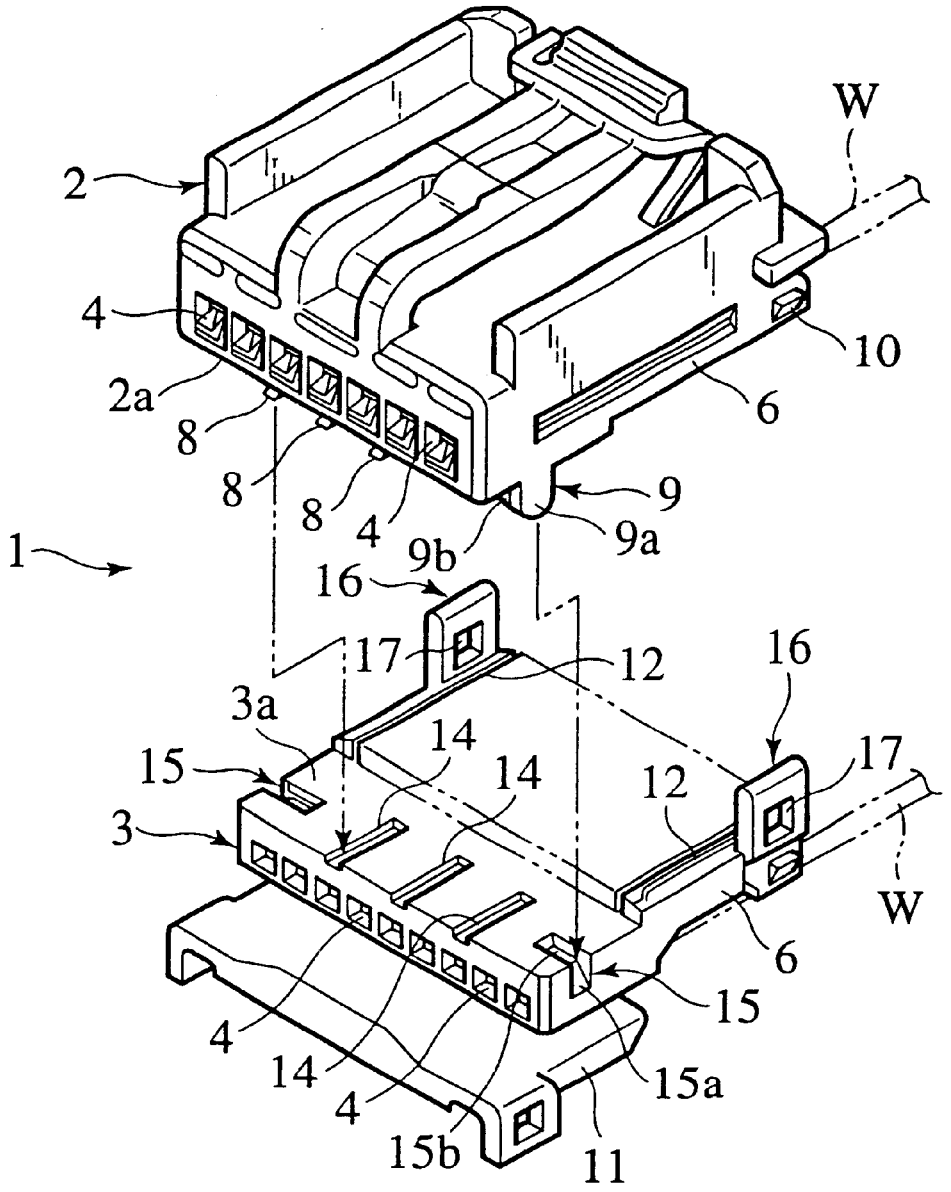
FIG.1 PRIOR ART
FIG. 1 is a perspective view showing a conventional art press-fit connector before its upper and lower connector housings are connected.
Figure 2:
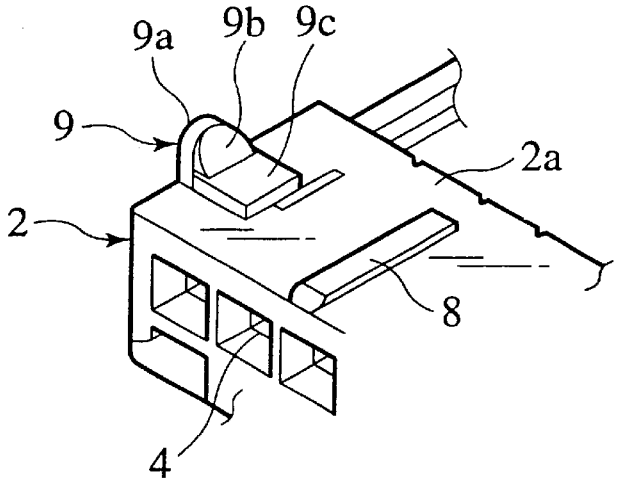
FIG.2 PRIOR ART
FIG. 2 is an enlarged perspective view of an essential portion of the upper connector housing of the conventional art as viewed from below.
Figure 3:
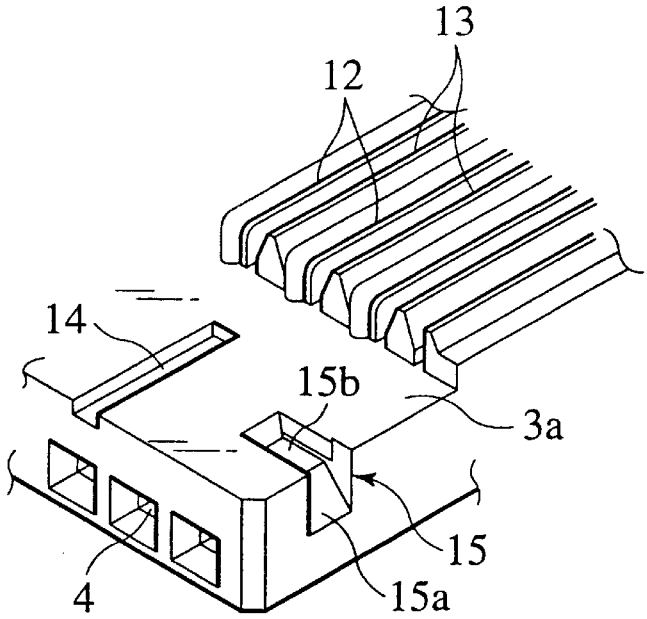
FIG.3 PRIOR ART
FIG. 3 is an enlarged perspective view of an essential portion of the lower connector housing of the conventional art as viewed from above.
Figure 4:
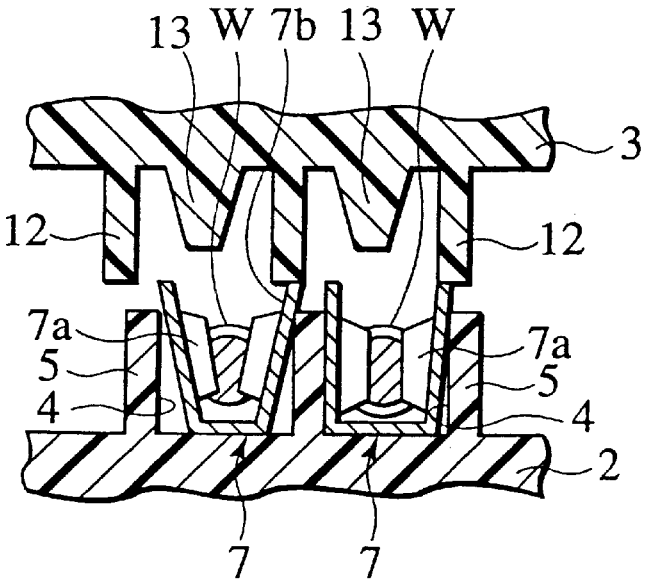
FIG.4 PRIOR ART
FIG. 4 is a sectional view of an essential portion of a state in which partition walls of the conventional art come into contact with press-fit terminals.
Figure 5:
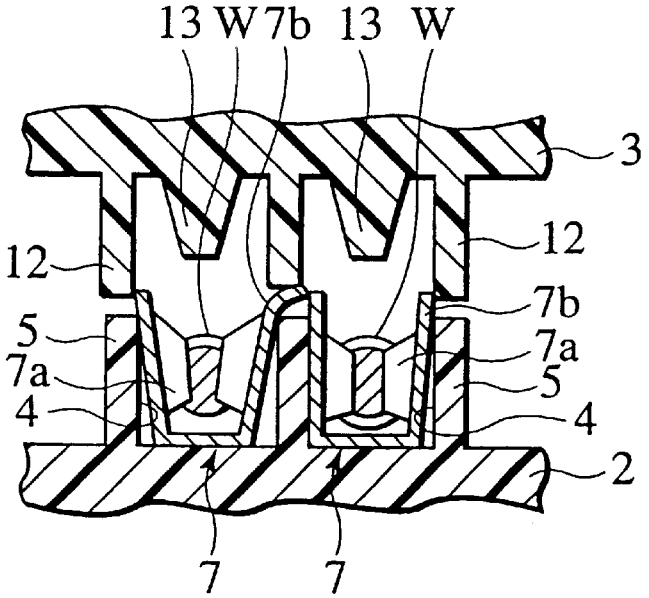
FIG.5 PRIOR ART
FIG. 5 is a sectional view of an essential portion of a state in which the press-fit terminals are deformed by a pushing force of the partition walls of the conventional art.
Figure 6:
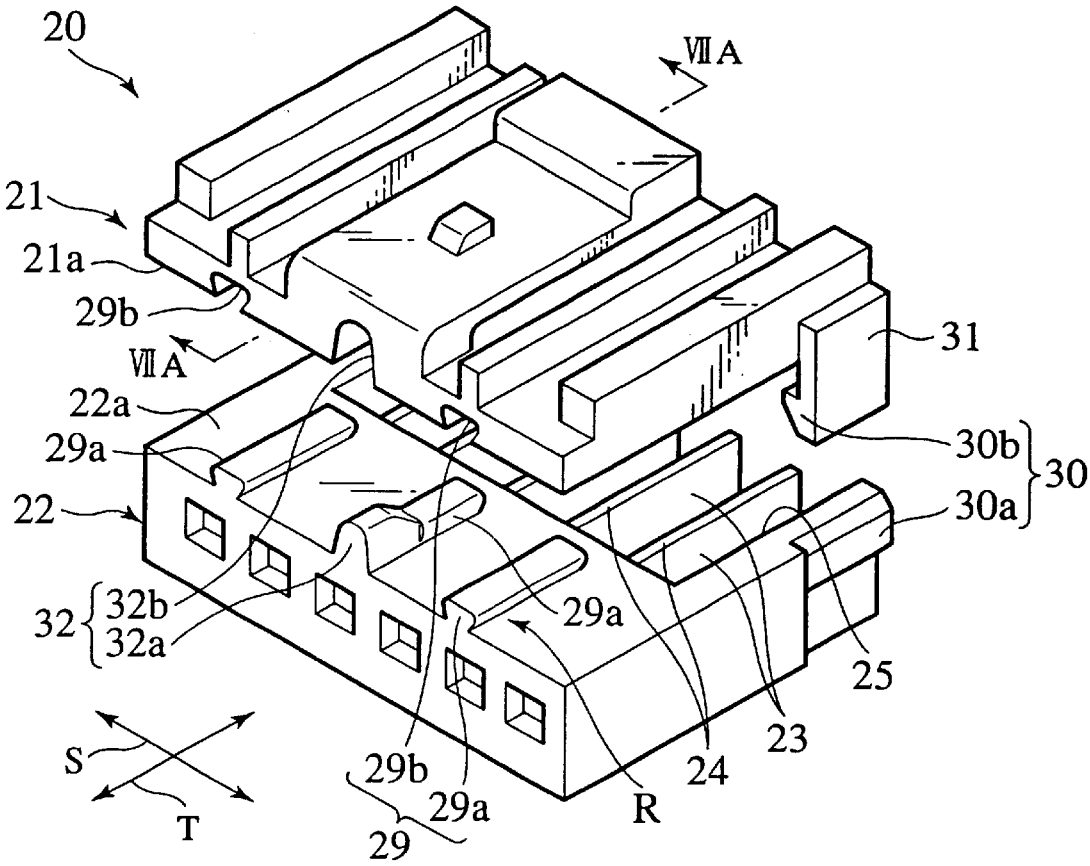
FIG. 6 is a perspective view of a press-fit connector according to an embodiment of the present invention before upper and lower connector housings are connected.
Figure 7A:
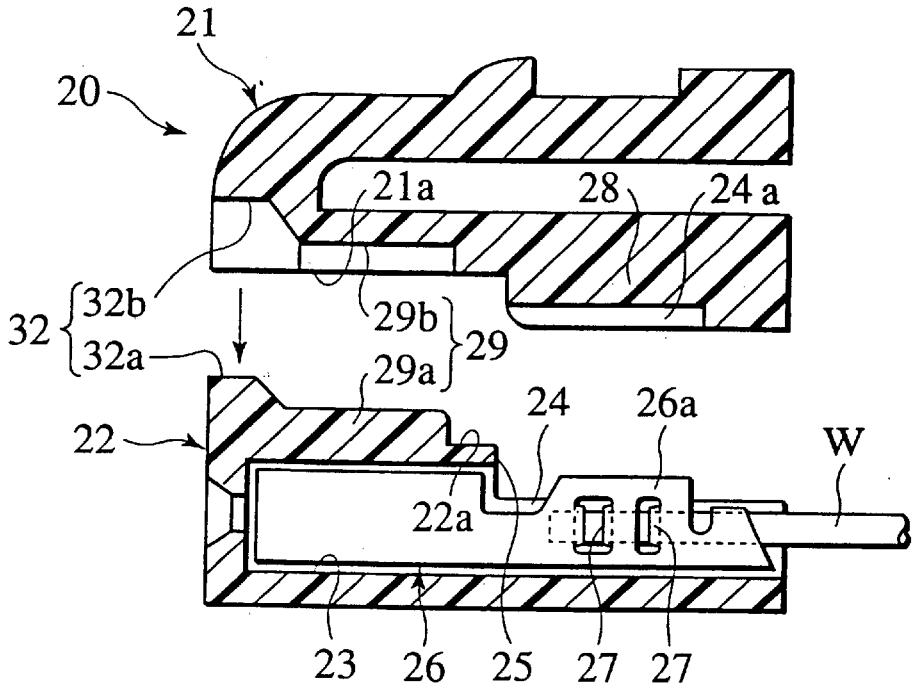
FIG. 7A is a sectional view taken along the line VIIA—VIIA in FIG. 6.
Figure 7B:
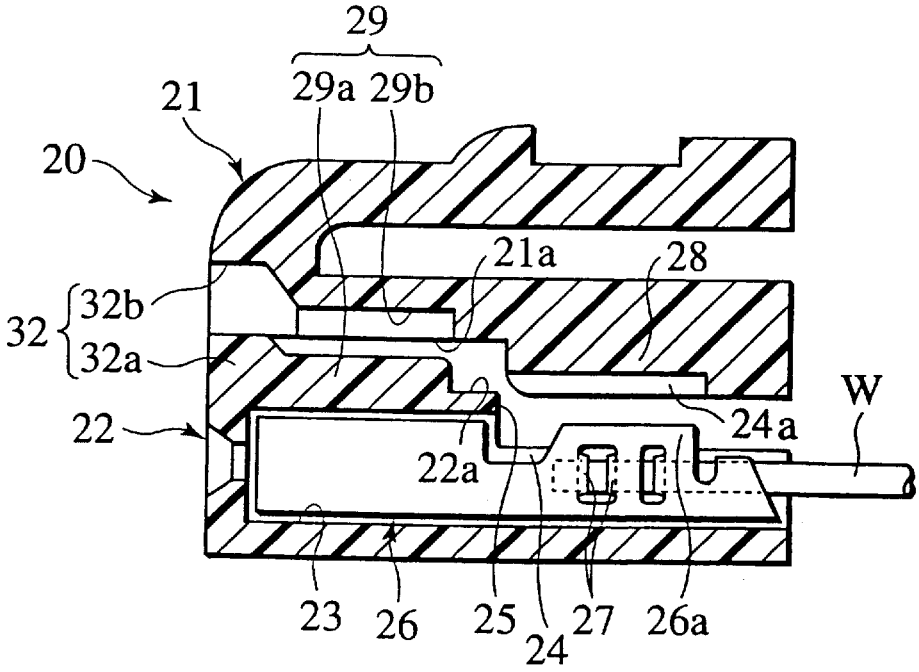
FIG. 7B is a sectional view of the press-fit connector showing a process of connecting operation thereof.
Figure 8:
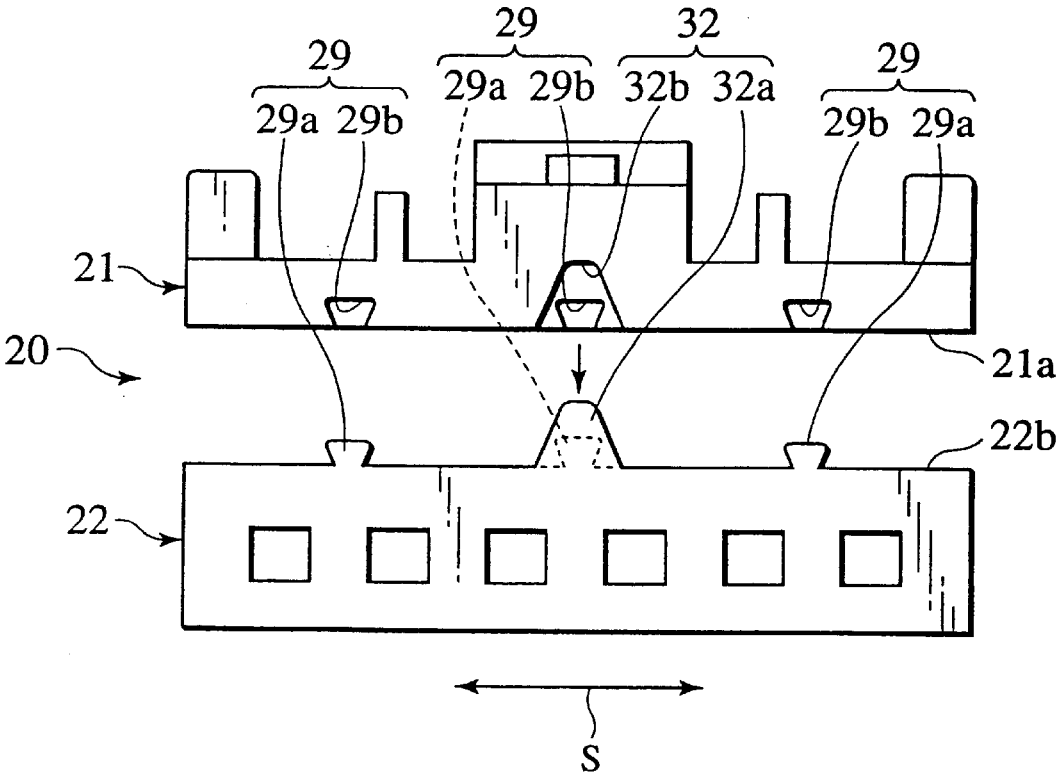
FIG. 8 is a front view of the connecting connector according to the embodiment of the invention.

As shown in FIGS. 6 to 8, a press-fit connector 20 comprises an upper cover 21 which is one of connector housings and a lower connector housing 22 which is the other connector housing. A lower face 21*a* of the upper cover 21 and an upper face 22*a* of the lower connector housing 22 are formed as connecting faces which are opposed to each other.

A plurality of longitudinally formed terminal accommodation chambers 23 are arranged side-by-side in the lower connector housing 22. The adjacent terminal accommodation chambers 23 are partitioned by partition walls 24. A rear portion of an upper face of the lower connector housing 22 is formed as an opening 25, and rear portions of the terminal accommodation chambers 23 are exposed from this opening 25. As shown in FIGS. 7A and 7B, press-fit terminals (terminals) 26 are respectively accommodated in the terminal accommodation chambers 23, and one end of an electric wire W is arranged to be press-fitted and connected to a pair of press-fit blades 27 and 27 of the press-fit terminals 26. Each of the press-fit blades 27 and 27 of the press-fit terminals 26 is bent into a substantially U-shape, tip ends 26*a* of opposite side plates of the press-fit terminal 26 project upward from the partition wall 24.

A rear portion of a lower face (connecting face) 21*a* of the upper cover 21 is provided with a plurality of partition walls 24 at position corresponding to the partition walls 24 of the lower connector housing 22. Electric wire restricting projections 28 are respectively provided between adjacent partition walls 24 like the conventional art.

Lock means R is for coupling and fixing the cover 21 and the connector housing 22 at a connecting position, and comprises front lock portions 29 and rear lock portions 30. Each of the front lock portion 29 comprises a locking projection 29*a* provided on a front portion of the upper face (connecting face) 22*a* of the connector housing 22, and a locking recess 29*b* provided on a front portion of the lower face (connecting face) 21*a* of the cover 21 at a position opposed to the locking projection 29*a*. If a direction in which the partition walls 24 are extended is defined as an extending direction T (longitudinal direction), the locking projections 29*a* and the locking recesses 29*b* are provided in three positions, i.e., a center position and left and right positions at certain distances from one another on the cover 21 and the connector housing 22 in a direction S perpendicular to the extending direction T, and are extended along the extending direction T. The locking projection 29*a* and the locking recess 29*b* in the center position are set shorter than the left and right locking projections 29*a* and the locking recesses 29*b* because undermentioned positioning means 32 is provided. Each the locking projection 29*a* is formed such that a width thereof becomes narrower from its tip end toward its root, and each the locking recess 29*b* is formed into a dovetail groove-shape in which its width is gradually increased from its entrance toward its inner or deeper side.

The rear lock portions 30 comprise locking steps 30*a* provided on rear portions of the opposite sides of the connector housing 22, and locking pawls 30*b* provided on a pair of resilient arms 31 and 31 projecting downward from rear portions of the opposite faces of the cover 21.

The positioning means 32 comprises a positioning projection 32*a* provided on a front portion of the upper face (connecting face) 22*a* of the connector housing 22 and at a substantially central position in the perpendicular direction S of the extending direction T, and a positioning recess 32*b* provided on the front portion of the lower face (connecting face) 21 of the cover 21 at a position opposed to the locking projection 29*a*. The locking projection 29*a* and the positioning recess 32*b* are extending in the extending direction T for positioning the cover 21 and the connector housing 22 in the direction S perpendicular to the extending direction T. The locking projection 29*a* and the positioning recess 32*b* are set higher and deeper than the locking projection 29*a* and the locking recess 29*b* so that the positioning operation is started earlier than the locking means R when the cover 21 and the connector housing 22 are moved to the connecting position. More specifically, their height and depth are set such that they start positioning before the partition walls 24 of the cover 21 and the press-fit terminals 26 of the housing 22 come to positions where they can come in contact to each other.

The positioning projection 32*a* is formed such that a width thereof gradually becomes narrower from its root toward its tip end, and the positioning recess 32*b* is formed such that its width gradually becomes narrower from its entrance toward its inner or deeper side, so that the positioning projection 32*a* can easily be inserted into the positioning recess 32*b*.

Next, the connecting operation between the cover 21 and the connector housing 22 will be explained. First, the press-fit terminals 26 are accommodated in the terminal accommodation chambers 23 of the lower connector housing 22.

Then, as shown in FIG. 7A, the lower face (connecting face) 21*a* of the upper cover 21 and the upper face (connecting face) 22*a* of the lower connector housing 22 are roughly positioned at a distance from each other, and the opposed connecting faces of the cover 21 and the connector housing 22 are moved in a direction in which they are relatively approach each other. Then, as shown in FIG. 7B, the positioning projection 32*a* first starts inserting into the positioning recess 32*b*, thereby positioning the cover 21 and the connector housing 22 in the direction S perpendicular to the extending direction T. With this positioning operation, the partition walls 24 of the cover 21 and the partition walls 24 of the connector housing 22 are moved in the direction in which they approach each other without deviating their positions.

Then, if the lower and upper faces are moved further, the partition walls 24 of the cover 21 come to position where they can come into contact with the press-fit terminals 26 of the cover 21. However, since both the partition walls 24 are always located at proper positions as described above, the tip end faces of the partition walls 24 of the cover 21 do not interfere with the tip ends 26*a* of the opposite side plates of the press-fit terminals 26, and are substantially brought into contact with the tip end faces of the partition walls 24 of the lower connector housing 22. With the above operation, it is possible to prevent the short out accident between the adjacent press-fit terminals 26 and 26.

Further, at the time of the connecting operation after the positioning operation by the positioning means 32, the locking projections 29*a* of the connector housing 22 are engaged with the locking recesses 29*b* of the cover 21, the locking pawls 30*b* of the resilient arms 31 of the cover 21 are engaged with the locking steps 30*a* of the connector housing 22, thereby locking both the connector housings to each other.

In the above embodiment, since the positioning projections 32*a* and the positioning recesses 32*b* are provided at the central portion of the cover 21 of the connector housing 22, the central position of the cover 21 and the connector housing 22 becomes a reference position. Therefore, error in position at opposite ends of the cover 21 and the connector housing 22 can be minimized.

Although the upper cover 21 is provided with the positioning recesses 32*b*, and the lower connector housing 22 is provided with the positioning projections 32*a* in the above embodiment, the upper cover 21 may be provided with the positioning recesses 32*a*, and the lower connector housing 22 may be provided with the positioning recesses 32*b* on the contrary. Further, the press-fit connector 20 is the cover 21 in which one of the connector housing does not have the terminal accommodating chambers in the embodiment, the present invention can of course be applied also to a connector in which both connector housings have terminal accommodating chambers.

What is claimed is:

1. A press-fit connector comprising:

a first connector housing;

a second connector housing;

locking means for locking the first and second housings when the first and second housings are coupled;

a plurality of first partition walls for partitioning the first connector housing into terminal accommodating chambers for accommodating terminals, the first partition walls having tip end faces;

a plurality of second partition walls for partitioning the second connector housing, the second partition walls having tip end faces, wherein the tip end faces of the first partition walls are opposite the tip end faces of the second partition walls when the first and second connector housings are coupled; and positioning means for bringing the tip end faces of the first and second partition walls into alignment with each other when the first and second connector housings are coupled; and wherein the positioning means operates prior to operation of the locking means, and wherein the positioning means extends in a direction of the length of the partition walls.

2. A press-fit connector according to claim 1, wherein the positioning means is provided at a substantially central portion of both the connector housings in a direction perpendicular to an extending direction.

3. The press-fit connector according to claim 1, wherein the positioning means is formed such that a width along the direction of a height of the partition walls thereof gradually becomes narrower from a root toward a tip end and a width along the direction of the length of the partition walls gradually becomes narrower from a front portion of the housing toward an inner or deeper side.

* * * * *